US006708699B2

(12) United States Patent
McGriff, III

(10) Patent No.: US 6,708,699 B2
(45) Date of Patent: Mar. 23, 2004

(54) APPARATUS AND METHOD FOR GROOMING DREADLOCKS

(76) Inventor: Alphonso McGriff, III, 1025 Blue Hills Ave., Bloomfield, CT (US) 06002

( * ) Notice: Subject to any disclaimer, the term of this patent is extended or adjusted under 35 U.S.C. 154(b) by 48 days.

(21) Appl. No.: 10/055,826

(22) Filed: Oct. 25, 2001

(65) Prior Publication Data

US 2002/0189629 A1 Dec. 19, 2002

Related U.S. Application Data

(60) Provisional application No. 60/297,870, filed on Jun. 13, 2001.

(51) Int. Cl.[7] ..... A45D 1/00
(52) U.S. Cl. ..... 132/269; 132/271
(58) Field of Search ..... 132/200, 211, 132/206, 207, 219, 229, 232, 233, 269, 271

(56) References Cited

U.S. PATENT DOCUMENTS 1,899,190 A * 2/1933 Fogelin ..... 132/219
4,739,151 A * 4/1988 Smal ..... 219/225
5,357,988 A * 10/1994 Nakamura ..... 132/232
5,769,100 A * 6/1998 Alexander ..... 132/271
5,783,800 A * 7/1998 Thompson et al. ..... 219/225
5,894,846 A * 4/1999 Gang ..... 132/201

FOREIGN PATENT DOCUMENTS

DE 4028134 A1 * 12/1992 ..... 132/200

* cited by examiner

*Primary Examiner*—Kevin Shaver
*Assistant Examiner*—Stephanie Willatt
(74) *Attorney, Agent, or Firm*—Robert S. Smith

(57) ABSTRACT

A dreadlock grooming apparatus which includes a first elongated open channel, a second elongated open channel, apparatus for registering the first elongated open channel with the second elongated open channel in opposed relationship, and apparatus for maintaining the first and second elongated open channels at a temperature above ambient temperature for a finite time period. In some embodiments the apparatus for registering the first open channel with the second open channel in opposed relationship may include meshing surfaces on the first and second channels. The first and second channels move along an associated dreadlock.

15 Claims, 7 Drawing Sheets

APPARATUS AND METHOD FOR GROOMING DREADLOCKS

RELATED APPLICATIONS

This application claims the priority of provisional U.S. patent application entitled "Alphonso's Lock and Braid Groomer"; Ser. No. 60/297,870; Filing Date Jun. 13, 2001; Confirmation No. 4798

BACKGROUND OF THE INVENTION

The invention relates to methods and apparatus for hair grooming and particularly to methods and apparatus for grooming dread-locks. The term "dreadlock" refers to a group of hairs extending from a small part of the scalp that are entangled and/or matted together. The term "dreadlocks" refers to a hair style that comprises at least one dreadlock and usually more than one. The size of the dreadlocks depends on the number of hairs entangled and/or matted amongst one another. The density of the dreadlocks depends on how tightly the individual hair shafts are packed. The term "lock" as used herein means "dreadlock".

The term "braid" and braiding refers to a distinct hair style and process in which typically three bundles of hair extending substantially one common part of the scalp are crossed over each other to form the braid. A braid or braided hair style typically utilizes a plurality of such braids. While the present invention has particular application to dreadlocks it will be understood that the apparatus in accordance with the present invention may be used to improve the definition of both dreadlocks and braids.

Typically, the development of dreadlocks is a process that takes several weeks and sometimes months when allowed to form by current dreadlock developing processes. The texture of the hair determines how long the hair has to be, how long it will take to lock, and what locking technique will be used. In most cases, during the locking process, the hairs health and aesthetics are the consumers' major concerns. Dreadlocks require repair if over twisting the hair roots has taken place, if the hair is overly dry, or if the dreadlocks are very long and the hair roots cannot support the weight of the locks. To repair the dreadlocks, the thin roots and thin lock shafts have to be tied in knots, and packed again.

Each strand of hair has imbrications or cuticle layers that are shingle or scale like layers. The imbrications extend up or out and away from the scalp. The flatter and smoother the imbrications are, the more shiny and healthy the hair is. If these Imbrications or cuticle layers are damaged, they will give the hair a dull and damaged look. However, most times if these Imbrications are peeling and damaged, the locking process is accelerated because damaged Imbrications help to entangle the hair, which is an essential part of the locking process. Conversely, peeling or damaged imbrications are not aesthetically pleasing because they present a dull looking appearance.

Historically, those who choose to grow dreadlocks have had a hard time with the frizzy, fluffy, puffed up and dull appearance during the initial and advanced stages of growth. Frizziness is a term that refers to the effect created by individual hairs that do not conform to the rope like envelope of the dreadlock. Such hairs result in dreadlocks that have a fluffy, puffed up, dull looking appearance. Because of this problem, many choose not to wear dreadlocks. Though this is a natural occurrence with the prior art process for those who choose dreadlocks, the appearance is perceived as nasty, unkempt, and ungroomed. As a result, there is a strong need for a tool and method to keep dreadlocks looking neat, polished and groomed.

SUMMARY OF THE INVENTION

It is an object of the invention to provide apparatus and a method for grooming dreadlocks that will accelerate the process of locking hair and assist in the lock development process by reducing the time it takes to achieve a healthy and aesthetically pleasing lock hair style.

Another object of the invention is to provide apparatus to smooth, pack, repair, and shine individual dreadlocks.

Still another object of the invention is to eliminate frizziness, to polish, to smooth, and to pack (increase the density) of the outer imbrications and non-conformed lock strands, to aid in repairing and to avoid an unkempt look.

It has now been found that these and other object of the invention may be attained in a lock grooming apparatus which includes a first elongated open channel, a second elongated open channel, apparatus for registering the first elongated open channel with the second elongated open channel in opposed relationship and is apparatus for maintaining the first and second elongated open channels at a temperature above ambient temperature for a finite time period.

In some embodiments the apparatus for registering the first open channel with the second open channel in opposed relationship may include meshing surfaces on the first and second channels. Such meshing surfaces may include ridges and grooves that mesh and are disposed along the sides of the channels. The apparatus for registering the first open channel with the second open channel in opposed relationship includes first and second arms in some embodiments of the invention. This apparatus may also include a pivot joining the first and second arms.

The first open channel may have a first axis, the second open channel may have a second axis and the pivot may have a third axis and each axis may be parallel to each other axis. The third axis may be proximate to the axial extremities of the first and second arms in some embodiments, although, and other embodiments the third axis may be disposed intermediate the axial extremities of both the first and second arms.

The first and second channels may each have a cylindrical section shape. The radius of curvature of the first and second channels may be substantially the same although alternatively the radius of curvature of the first and second channels may be different. In some embodiments at least one of the channels is in open generally rectangular cross-section channel. In others both of the channels are open generally rectangular cross-section channels. In some cases at least one of the channels has a truncated conical shape. In others both of the channels have a truncated conical shape.

Each channel having a truncated conical shape may have a first axial extremity having a cross-section having a larger radius of curvature than a second axial extremity thereof. The first axial extremities of the first and second channels may be proximate and the second axial extremities of the first and second channels may be proximate. The apparatus for maintaining the first and second elongated open channels at a temperature above ambient temperature for a finite time period may include an electric resistance heater.

In other forms of the invention this apparatus includes a thermal heat reservoir or a combustion apparatus.

The invention also includes the method of developing a lock which comprises the sequential steps of shampooing the hair, massaging oil into the hair, twisting groups of hair that are adjacent on the scalp about an axis of the respective groups of hairs, positioning the heated lock groomer around each lock proximate to the scalp and sliding the lock goomer along the entire axial extent of the lock.

BRIEF DESCRIPTION OF THE DRAWING

The invention will be better understood by reference the accompanying drawing in which.

DESCRIPTION OF THE PREFERRED EMBODIMENTS

The invention relates to a device used for the purposes of grooming dreadlocks. The tool is also used to smooth, pack, repair, and shine individual dreadlock. The characteristics of the device contributes to shortening the process of locking individual dreadlocks in many cases by weeks and it assists in maintaining the results of the hair's natural locking process.

Figure 1:
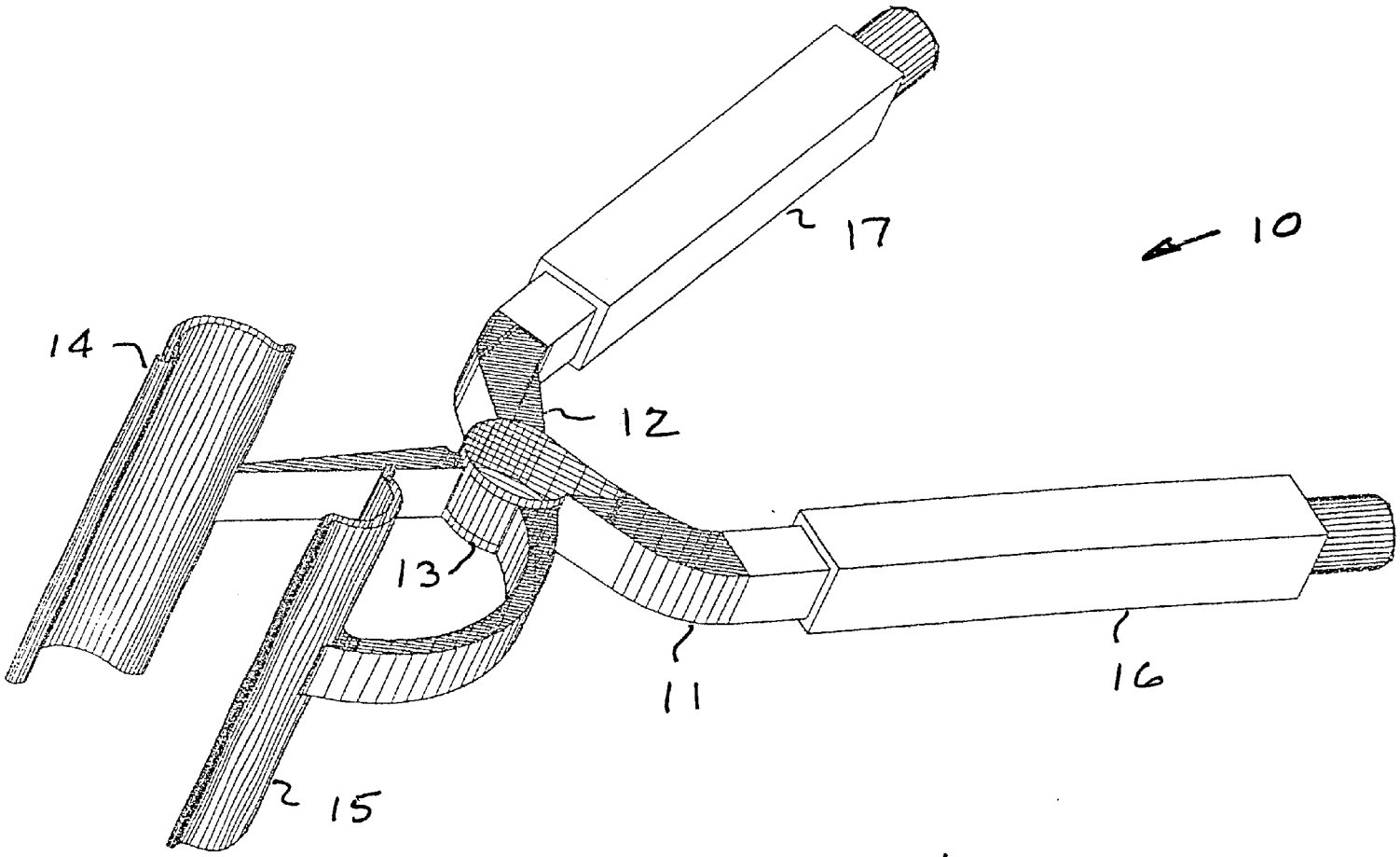
FIG. 1 is a perspective view of a first embodiment of the grooming apparatus in accordance with present invention that includes two arms pivotally connected at a point intermediate the axial extremities thereof and which have two opposed cylindrical section shaped channels, each having the same radius of curvature, are dimensioned and configured for engagement with the lock.

Referring now configured 1–6 there are shown six embodiments of the present invention. The grooming tool 10 illustrated in FIG. 1 is a first embodiment of the grooming apparatus in accordance with present invention. The grooming tool 10 includes two arms 11, 12 that are pivotally connected at a pivot 13 intermediate the axial extremities thereof. Two opposed cylindrical section shaped channels 14, 15, each having the same radius of curvature, are dimensioned and configured for engagement with the lock. The cylindrical section shaped channels 14, 15 are fixed respectively to the axial extremities of the arms 11, 12 and have respective axes that are disposed in parallel relationship to the axes of the pivot 13. The arms 11, 12 have respective handles 16, 17 that permit the user to position the channels 14, 15 into engagement with a lock.

Figure 2:
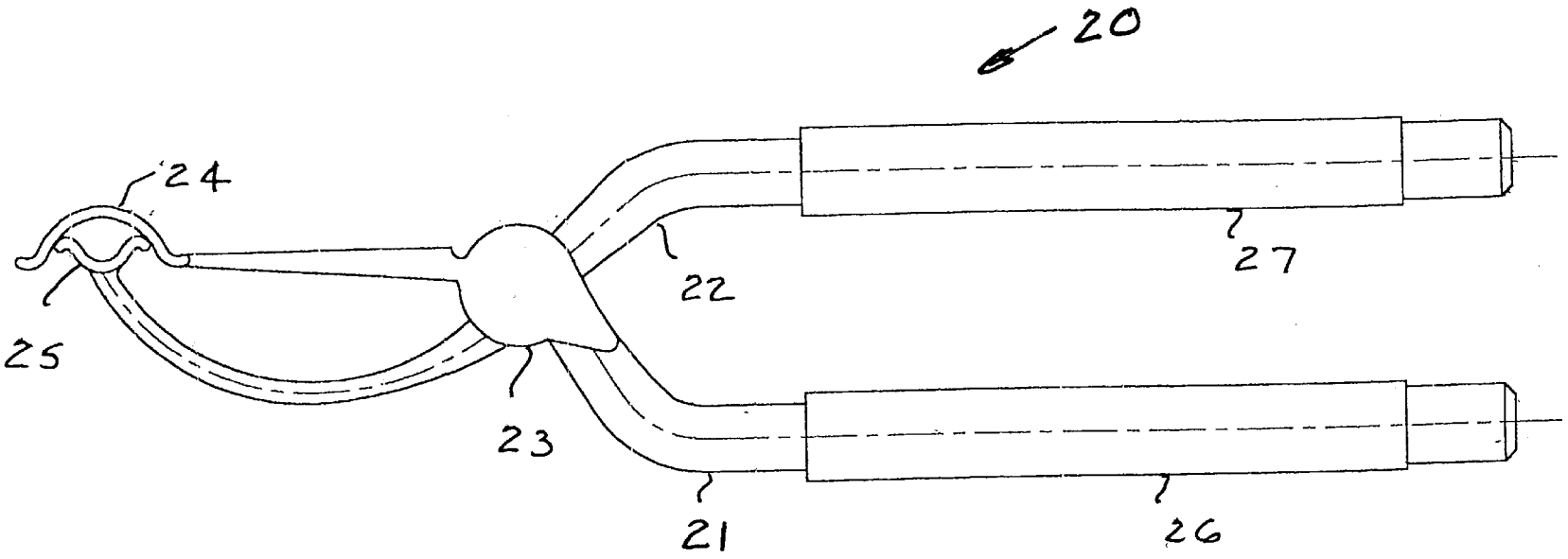
FIG. 2 is a front elevation view of a second embodiment of the grooming apparatus in accordance with present invention that includes two arms pivotally connected at a point intermediate the axial extremities thereof and which have two opposed cylindrical section shaped channels, each having a different radius of curvature, dimensioned and configured for engagement with the lock.

The grooming tool 20 illustrated in FIG. 2 is a second embodiment of the grooming apparatus in accordance with present invention. The tool 20 includes two arms 21 22 that are pivotally connected at a pivot 23 intermediate the axial extremities thereof. Two opposed cylindrical section shaped channels 24, 25 have respective axes that are usually parallel as well as parallel to the axes of the pivot 23. The channels 24, 25 have a different radius of curvature although they are also dimensioned and configured for engagement with a lock. Channel 26, 27 are positioned on the axial extremities of the arms 21, 22 to allow manipulation of the channels 24, 25 by a user.

Figure 3:
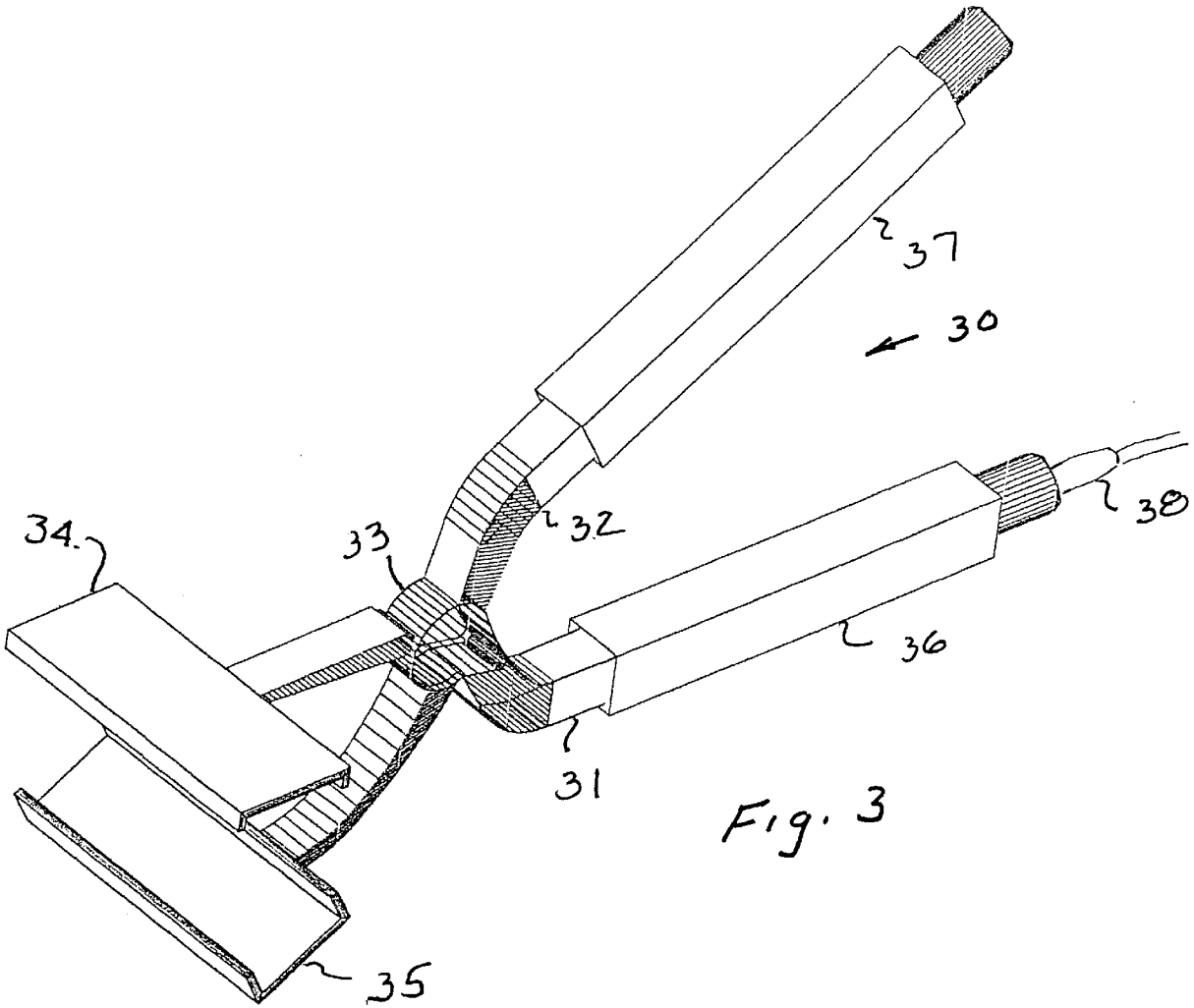
FIG. 3 is a perspective view of a third embodiment of the grooming apparatus in accordance with present invention that includes two arms pivotally connected at a point intermediate the axial extremities thereof and which has two opposed open rectangular cross-section channels are dimensioned configured for engagement with a lock and which further includes an internal heating element and a power cable for connection to the internal he element.

FIG. 3 is a perspective view of grooming tool 30 in accordance with a third embodiment of the grooming apparatus in accordance with a third embodiment of the present invention that includes two arms 31, 32 pivotally connected by a pivot 33 intermediate the axial extremities thereof. The grooming tool 30 has two opposed open rectangular cross-section channels 34, 35 fixed to the axial extremities of the arms 31, 32 with the respective axes thereof disposed in usually parallel relationship and in parallel relationship to the axis of the pivot 33. The open rectangular cross-section channels 34, 35 are dimensioned and configured for engagement with a lock. Handles 36, 37 our provide a respectively on the arms 31, 32 to allow manipulation of the channels 34, 35. The grooming tool 30 further includes an internal heating element disposed within the handle 36. A power cable 38 is provided for connection of the internal heating element disposed within the handles 36 to a residential or commercial electric power socket.

Figure 4:
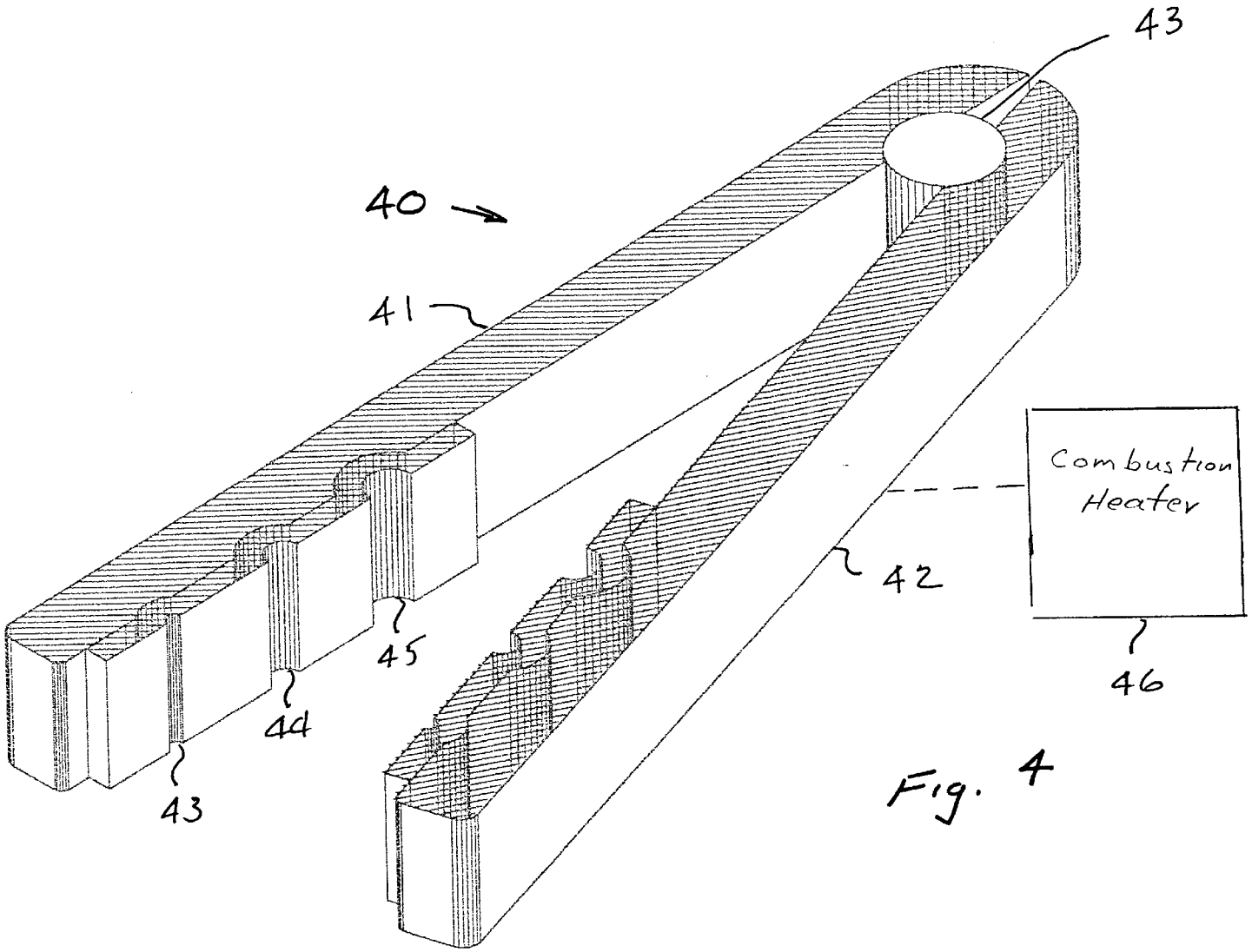
FIG. 4 is a partially schematic perspective view of a fourth embodiment of the grooming apparatus in accordance with present invention that includes two arms pivotally connected at a point proximate to the axial extremities of the arms and which includes multiple opposed cylindrical section shaped channels that are dimensioned configured for engagement with a lock and which illustrates schematically an integral combustion heater.

The grooming tool 40 illustrated in FIG. 4 is a partially schematic perspective view of a fourth embodiment of the grooming apparatus in accordance with present invention. This embodiment includes two arms 41, 42 that are pivotally connected at a pivot 43 proximate to the axial extremities of the arms 41, 42 and which includes multiple opposed cylindrical section shaped channels 43, 44, 45 that are dimensioned and configured for engagement with a dreadlocks of different sizes. An integral combustion heater 46 is illustrated schematically. The structure for producing such heat is disclosed in U.S. Pat. No. 4,800,654 issued to Levin et al on Jan. 31, 1989 for A Hand-held Cordless Hairdryer and U.S. Pat. No. 6,058,944 issued to order on May 9, 2000 for a Combustion Heated Hairdryer. The disclosures of these patents are incorporated by reference.

Figure 5:
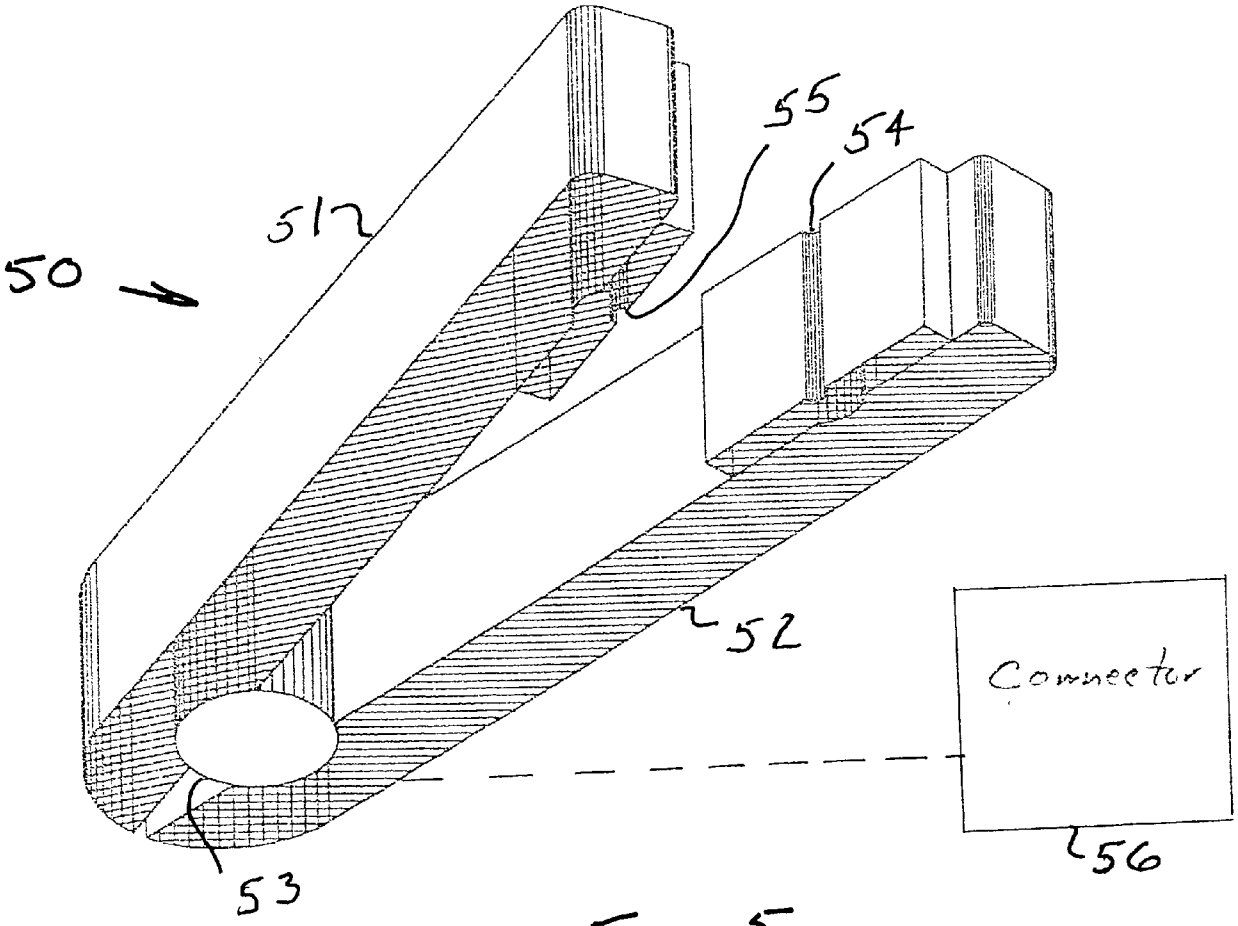
FIG. 5 is a partially schematic perspective view of a fifth embodiment of the grooming apparatus in accordance with the present invention that includes two arms pivotally connected at a point proximate to the axial extremities of the arms and which includes opposed cylindrical section shaped channels that are dimensioned configured for engagement with a lock and which illustrates schematically an electrical connector for connection with a cradle (not shown) to supplying electric power to an integral electric resistance heater.

The grooming tool 50 illustrated in FIG. 5 is a partially schematic perspective view of a fifth embodiment of the grooming apparatus in accordance with the present invention. The tool 50 includes two arms 51, 52 that are pivotally connected at a pivot 53 proximate to the axial extremities of the arms 51, 52. Two opposed cylindrical section shaped channels 54, 55 are dimensioned and configured for engagement with a lock. The apparatus includes an electrical connector 56 for connection with a cradle (not shown) to supply electric power to an integral electric resistance heater disposed within the arm 52. Preferably the material, at least in which the channels 54, 55 are disposed, is a thermal heat reservoir. In the manner described in U.S. Pat. No. 5,195,253 the grooming tool 50 utilizes the connector 56 to connect to a cradle (not shown) to provide electric power to a heater disposed within the handle 52. Preferably the thermal qualities of the structure provides a sufficient thermal heat reservoir to maintain the required temperature at the channels 54, 55. In this embodiment the user does not have an electric cord dangling from the tool 50. The disclosure of U.S. Pat. No. 5,195,253 is incorporated by reference.

Figure 6:
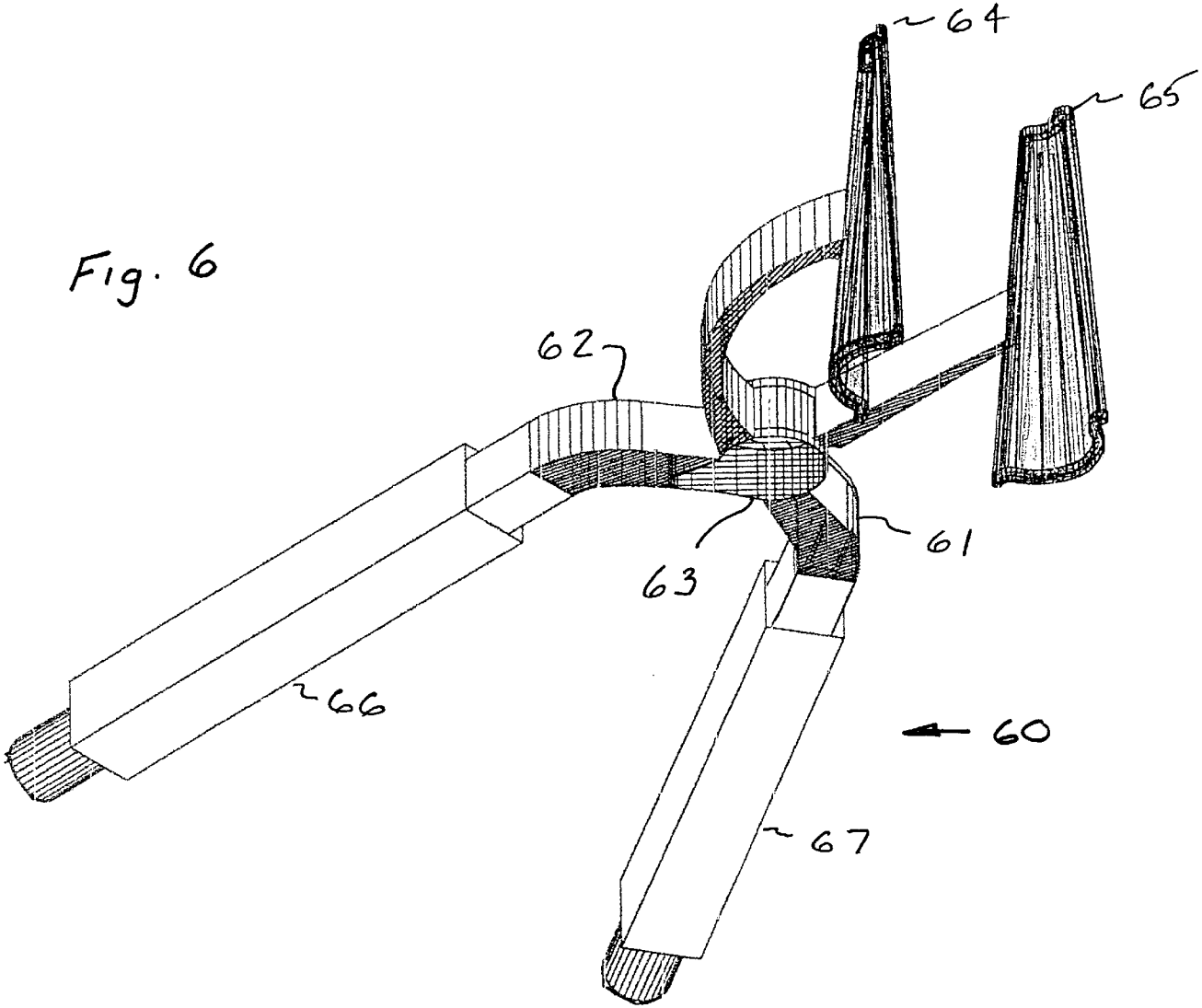
FIG. 6 is a perspective view of a sixth embodiment of the grooming apparatus in accordance with the present invention illustrating two arms pivotally connected at a point intermediate the axial extremities thereof and having two truncated conical opposed channels are dimensioned configured for cooperating with a lock.

The grooming tool 60 illustrated in FIG. 6 is a sixth embodiment of the grooming apparatus in accordance with the present invention. The tool 60 includes two arms 61, 62 that are pivotally connected at a pivot 63 intermediate the axial extremities thereof. Two truncated conical opposed channels 64, 65 are dimensioned configured for cooperating with a lock. Two handles 66, 67 dispose respectively on arms 62, 61 allow the user to manipulate the opposed channels 64, 65.

Figure 7:
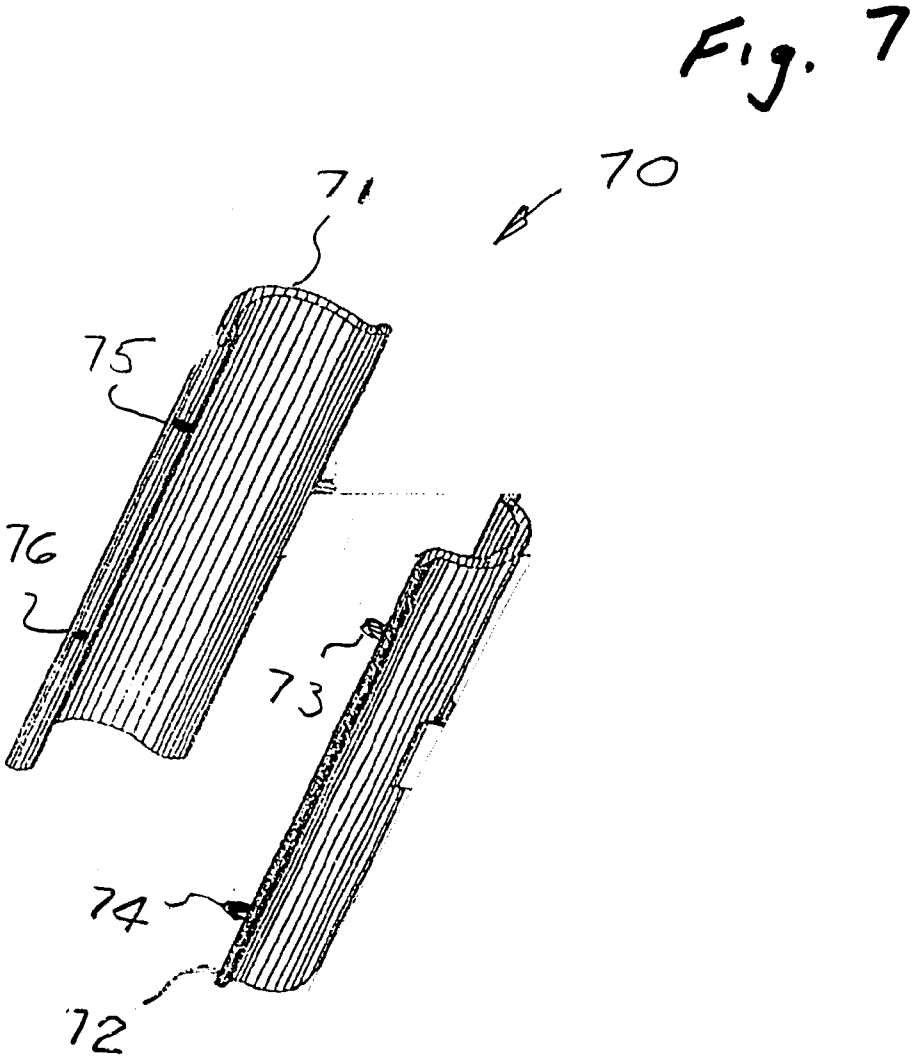
FIG. 7 is a perspective view of a seventh embodiment of the grooming apparatus in accordance with present invention that illustrates two opposed sleeves.

The grooming tool 70 illustrated in FIG. 7 is a simplified embodiment of the apparatus of the present invention. The tool 70 includes first and second insulated metallic channels 71, 72. The channel 72 is provided with means for registering the channel with the opposed channels 71. In the illustrated embodiment the channel 72 is provided with locating pins 73, 74 that are dimensioned and configured for registration with recesses 75, 76 in channel 71. In use the metallic surfaces of the respective channels are heated either by an internal heat source or by an external heat source. The user then grasps the thermally insulated surfaces of the channels 71, 72 and positions them in opposed relationship around the lock to be groomed near the scalp and slides the two channels 71, 72 axially along the entire axial extent of the lock.

The grooming apparatus in accordance with the invention achieves a healthy and aesthetically pleasing lock. The process requires first and second opposed channels that are dimensioned and configured to snugly engage in surround respective axial sections of each lock. More specifically, to achieve the desired effect the engagement must be by means of opposed channels that are heated. It is preferable that the surfaces be heated. The temperature required varies based on the hair texture and the condition of the hair, namely, whether it's healthy or damaged. Those skilled in the art will recognize the temperature required will be similar to the temperature that is required for hair curling and hair straightening.

The heating of the opposed channels may be accomplished in various ways. In the embodiments grooming tool 10, 20 and 60 shown in FIGS. 1, 2 and 6 the heating may be achieved by placement of the grooming tool within a heated chamber such as an oven (not shown) or placement on a hot plate (not shown) or similar heat source. Although aluminum is a preferred material for the channels of the tools other embodiments may use materials which will act as a thermal heat reservoir such as cast iron.

The lock groomer 30 is heated by means of an internal resistance heater is connected by a power cord 38 to an associated electric socket (not shown). The lock groomer 40 is heated by means of a combustion heater 46 as described above. The lock groomer 50 is heated by an internal electric resistance element when the connector 56 thereof is placed within a cradle (not shown). The resistance element heats a thermal heat reservoir that will maintain a temperature at the channels 54, 55 to enable the user to perform the required procedures.

Other embodiments of the lock groomer will vary with respect to the size thereof and the size of the lock with which the groomer is dimensioned to engage. The lock groomer 40 is an example of embodiment that provides a plurality of channels 43, 44, 45 to cooperate with dreadlocks of different sizes. The grooming process requires that the opposed channels of the lock groomer snugly engage axial portions of the respective dreadlocks. More specifically, the process requires that the channels sequentially engage axial portions of the respective dreadlocks until the entire axial extent of the lock has been groomed. Preferably the dreadlocks will be engaged by the channels of the lock groomer initially at the base or root of the lock next to the scalp. Thereafter, the tool is sequentially moved along the axial extent of the lock to complete the grooming process. In some case the tool is held at sequential axial positions for a few seconds to apply light pressure to the lock. Often the lock, before packing, will be larger in cross-section than the cross-section of the respective channels.

Although the preferred embodiments illustrated in FIGS. 1–6 utilize pivotally mounted levers to mount opposed channels that are dimensioned for close conforming engagement with a lock, those skilled in the art will recognize that other mechanical arrangements are possible. Such other mechanical arrangements preferably allow movement of the opposed channel shaped members apart and allow movement together in registered relationship. The embodiment of FIG. 7 is one such embodiment. Various structure for heating the channels has been disclosed herein. It will be understood that any such structure may be employed in any embodiment. Similarly, various shapes for the channels have been disclosed herein. You'll also be understood that any such structure may be employed in any embodiment.

The method to polish, smooth, pack, and help to repair and keep dreadlocks healthy and looking properly groomed involves sequentially:

1. Shampoo and condition the hair or dreadlocks, depending on whether the locking process has been started already.
2. Massage liquid oil throughout hair, or dreadlocks.
3. If dreadlocks have been started already, apply a small amount of wax or gel depending of the texture and condition of hair to new growth and twist roots using a palm roll method or comb method.
4. If dreadlocks have not been started, section hair, apply a small amount of wax or gel, depending on the texture and condition of hair and twist hair from roots, or base of the scalp out to the ends of hair using a comb.
5. When full the full head has been twisted, allow hair, or dreadlocks to totally dry.
6. After the dreadlocks have been totally dried, apply a small amount of wax to palms of hands and roll dreadlocks between hands, coating dreadlocks with wax.
7. Spray dreadlocks with a light mist of spritz or holding spray.
8. Position the heated lock groomer around each lock proximate to the scalp. Thereafter, the tool is sequentially moved along the axial extent of the lock to complete the grooming process. In some case the tool is held at sequential axial positions for a few seconds to apply light pressure to the lock.

It will thus be seen that the apparatus and a method for grooming dreadlocks in accordance with the present invention will accelerate the process of locking hair and assist in the lock development process by reducing the time it takes to achieve a healthy and aesthetically pleasing lock hair style. It will thus be seen that the apparatus and method will smooth, pack, repair, and shine individual dreadlocks as well as eliminating frizziness, polishing, smoothing, and packing or increasing the density of the outer imbrications and conforming individual hair strands to the desired envelope of the lock and aiding in the repair and maintenance of the dreadlocks.

The invention has been described with reference to the preferred embodiments. Persons skilled in the art of such inventions may upon exposure to the teachings herein, conceive other variations. Such variations are deemed to be encompassed by the disclosure, the invention being delimited only by the following claims.

What is claimed is:

1. A dreadlock grooming apparatus which comprises:

a first elongated open channel, said first open channel has a first axis, a second elongated open channel, said second open channel has a second axis means for registering said first elongated open channel with said second elongated open channel in opposed relationship including meshing surfaces on said first and second channels and first and second arms and a pivot joining said first and second arms;

said first elongated open channel having first and second open axial extremities whereby said open first elongated channel may be sequentially moved along axial portions of an associated dreadlock;

said second elongated open channel having first and second open axial extremities whereby said open second elongated channel may be sequentially moved along axial portions of an associated dreadlock;

said pivot has a third axis, each said axis being parallel to each other said axis, said third axis being disposed intermediate the axial extremities of both said first and second arms; and means for maintaining said first and second elongated open channels at a temperature above ambient temperature for a finite time period.

2. The dreadlock grooming apparatus in accordance with claim 1 wherein said first and second channels each have a cylindrical section shape.

3. The dreadlock grooming apparatus in accordance with claim 1 wherein the radius of curvature of said first and second channels is substantially the same.

4. The dreadlock grooming apparatus in accordance with claim 1 wherein the radius of curvature of said first and second channels is different.

5. The dreadlock grooming apparatus in accordance with claim 1 wherein at least one of said channels is in open generally rectangular cross-section channel.

6. The dreadlock grooming apparatus in accordance with claim 1 wherein both of said channels are open generally rectangular cross-section channels.

7. The dreadlock grooming apparatus in accordance with claim 1 wherein said means for maintaining said first and second elongated open channels at a temperature above ambient temperature for a finite time period includes an electric resistance heater.

8. The dreadlock grooming apparatus in accordance with claim 1 wherein said means for maintaining said first and second elongated open channels at a temperature above ambient temperature for a finite time period includes a thermal heat reservoir.

9. The dreadlock grooming apparatus in accordance with claim 1 wherein said means for maintaining said first and second elongated open channels at a temperature above ambient temperature for a finite time period includes a combustion apparatus.

10. The dreadlock grooming apparatus in accordance with claim 2 wherein said means for maintaining said first and second elongated open channels at a temperature above ambient temperature for a finite time period includes an electric resistance heater.

11. The dreadlock grooming apparatus in accordance with claim 2 wherein said means for maintaining said first and second elongated open channels at a temperature above ambient temperature for a finite time period includes a thermal heat reservoir.

12. The dreadlock grooming apparatus in accordance with claim 1 wherein said means for maintaining said first and second elongated open channels at a temperature above ambient temperature for a finite time period includes a combustion apparatus.

13. The dreadlock grooming apparatus in accordance with claim 3 wherein said means for maintaining said first and second elongated open channels at a temperature above ambient temperature for a finite time period includes an electric resistance heater.

14. The dreadlock grooming apparatus in accordance with claim 3 wherein said means for maintaining said first and second elongated open channels at a temperature above ambient temperature for a finite time period includes a thermal heat reservoir.

15. The dreadlock grooming apparatus in accordance with claim 3 wherein said means for maintaining said first and second elongated open channels at a temperature above ambient temperature for a finite time period includes a combustion apparatus.

* * * * *